US012116647B2

(12) United States Patent
Li et al.

(10) Patent No.: US 12,116,647 B2
(45) Date of Patent: Oct. 15, 2024

(54) COLD-ROLLED ANNEALED DUAL-PHASE STEEL, STEEL PLATE, AND MANUFACTURING METHOD THEREFOR

(71) Applicant: BAOSHAN IRON & STEEL CO., LTD., Shanghai (CN)

(72) Inventors: Wei Li, Shanghai (CN); Xiaodong Zhu, Shanghai (CN); Peng Xue, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 1322 days.

(21) Appl. No.: 16/621,495

(22) PCT Filed: Jun. 26, 2018

(86) PCT No.: PCT/CN2018/092879

§ 371 (c)(1),
(2) Date: Dec. 11, 2019

(87) PCT Pub. No.: WO2019/001424

PCT Pub. Date: Jan. 3, 2019

(65) Prior Publication Data

US 2023/0098505 A1 Mar. 30, 2023

(30) Foreign Application Priority Data

Jun. 29, 2017 (CN) ..... 201710514480.7

(51) Int. Cl.

| | |
|---|---|
| ***C21D 8/02*** | (2006.01) |
| ***C21D 6/00*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/38*** | (2006.01) |

(52) U.S. Cl.

CPC ..... *C21D 8/0263* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C22C 38/001* (2013.01); *C22C 38/002* (2013.01); *C22C 38/02* (2013.01); *C22C 38/06* (2013.01); *C22C 38/22* (2013.01); *C22C 38/26* (2013.01); *C22C 38/28* (2013.01); *C22C 38/38* (2013.01); *C21D 2211/005* (2013.01); *C21D 2211/008* (2013.01)

(58) Field of Classification Search

None

See application file for complete search history.

(56) References Cited

U.S. PATENT DOCUMENTS

2017/0001670 A1* 1/2017 Grüneklee ..... B29C 45/14811

FOREIGN PATENT DOCUMENTS

| | | | | | |
|---|---|---|---|---|---|
| CN | 101802233 | | | 8/2010 | |
| CN | 101802233 | A | | 8/2010 | |
| CN | 102586688 | A1 | | 7/2012 | |
| CN | 103469112 | A | * | 12/2013 | ..... C21D 6/005 |
| CN | 103952523 | | | 7/2014 | |
| CN | 103987868 | | | 8/2014 | |
| CN | 103987868 | A | | 8/2014 | |
| EP | 2031081 | | | 3/2009 | |
| JP | 2007-9269 | | | 1/2007 | |
| JP | 2007009269 | A | * | 1/2007 | |
| KR | 10-2011-0067159 | | | 6/2011 | |
| WO | 2015043411 | A1 | | 4/2015 | |

OTHER PUBLICATIONS

Ming Sheng Tu, Wenbing Yan Brittle Fracture of low alloy steels at low temperatures first edition, edited by Tu Mingjing and Yan Wenbin, Second Edition 124 125, Xi'an Jiaotong University Press, Jul. 1, 1985.

Di Tang et al. Advanced high strength strip steel for automobiles "", , 1st edition, edited by Tang Di et al., pp. 137 138 , Golden industry press, Oct. 2, 2016.

1st and 2nd Office Action for CN App No. 201710514480.7.

EP OA for EP App. No. 18824845.4.

KR OA for KR App. No. 10-2019-7038710.

India Office Action dated Nov. 25, 2021 for App.No. 201947054287.

International Search Report and Written Opinion mailed on Sep. 11, 2018 for PCT Patent No. PCT/CN2018/092879.

* cited by examiner

*Primary Examiner* — Anthony M Liang

(74) *Attorney, Agent, or Firm* — Lei Fang, Esq.; Smith Tempel Blaha LLC

(57) ABSTRACT

A cold-rolled annealed dual-phase steel is provided, having a microstructure of ferrite and martensite, and comprising the following chemical elements in mass percentage: 0.08% to 0.1% of C, 1.95% to 2.2% of Mn, 0.1% to 0.6% of Si, 0.020% to 0.050% of Nb, 0.020% to 0.050% of Ti, 0.015% to 0.045% of Als, 0.40% to 0.60% of Cr, 0.2% to 0.4% of Mo, 0.001% to 0.005% of Ca, and the balance being Fe and other inevitable impurities. A method for manufacturing the cold-rolled annealed dual-phase steel is also provided, comprising the steps of: (1) smelting and casting; (2) hot rolling; (3) cold rolling; (4) annealing; and (5) temper rolling.

4 Claims, No Drawings

COLD-ROLLED ANNEALED DUAL-PHASE STEEL, STEEL PLATE, AND MANUFACTURING METHOD THEREFOR

CROSS-REFERENCE TO RELATED APPLICATIONS

This application is a 371 U.S. National Phase of PCT International Application No. PCT/CN2018/092879 filed on Jun. 26, 2018, which claims benefit and priority to Chinese patent application no. 201710514480.7, filed on Jun. 29, 2017. Both of the above-referenced applications are incorporated by reference herein in their entireties.

TECHNICAL FIELD

The present invention relates to a steel and a method for manufacturing the same, and more particularly to a dual-phase steel and a method for manufacturing the same.

BACKGROUND ART

In the automotive industry, steel plates with higher strength are required for weight reduction. Accordingly, ultra-high-strength dual-phase steel with tensile strength of 980 Mpa or more is becoming the first choice for the automotive industry, because this strength grade of steel can effectively reduce the weight of car body and improve safety. In order to reduce the self-weight of the car body and achieve the purpose of reducing energy consumption, while ensuring the safety performance of the car body, high-strength steel, especially advanced high-strength steel, is used more and more in the design of the car body. Dual-phase steel is widely used in the production of automotive parts due to its excellent properties such as low yield strength, high tensile strength and high initial work hardening rate. However, as the demand for thinning is getting higher and higher, users even have a demand for steel with a thickness of 0.5 to 0.7 mm, especially in the use of car seats.

However, at present, the thickness of an ultra-high strength grade of cold-rolled annealed dual-phase steel is mostly between 1.0 and 2.3 mm.

In view of this, it is desired to obtain an ultra-thin 1000 MPa-grade dual-phase steel to meet industrial requirements.

SUMMARY OF THE INVENTION

One of the objects of the present invention is to provide a cold-rolled annealed dual-phase steel having a tensile strength of 1000 MPa or more, an elongation at break of 12% or more and excellent bending property.

In order to achieve the above object, the present invention provides a cold-rolled annealed dual-phase steel, wherein the steel has a microstructure of ferrite and martensite, and comprises the following chemical elements in mass percentage:

0.08% to 0.1% of C, 1.95% to 2.2% of Mn, 0.1% to 0.6% of Si, 0.020% to 0.050% of Nb, 0.020% to 0.050% of Ti, 0.015% to 0.045% of Als, 0.40% to 0.60% of Cr, 0.2% to 0.4% of Mo, 0.001% to 0.005% of Ca, and the balance being Fe and other inevitable impurities.

The inventors designed the chemical elements of the cold-rolled annealed dual-phase steel according to the present invention, and the design principle is as follows:

Carbon: In the cold-rolled annealed dual-phase steel according to the present invention, carbon is a solid solution strengthening element, for ensuring to obtain high strength of the material. When the mass percentage of carbon is too high or too low, it is not conducive to the performance of steel. Therefore, the mass percentage of carbon is between 0.08 and 0.1%. If the mass percentage of carbon is less than 0.08%, the austenite content is low when heated in the same critical region (ferrite and austenite), resulting in insufficient strength. If the mass percentage of carbon is higher than 0.1%, the carbon equivalent increases and the weldability is unfavorable.

Manganese: Mn is an element that strongly enhances the hardenability of austenite, and effectively increases the strength of steel, but is disadvantageous for welding. Therefore, the mass percentage of Mn is 1.95 to 2.2%. When the mass percentage of Mn is less than 1.95%, the strength of the steel is insufficient. When the mass percentage of Mn is higher than 2.2%, both the strength of the steel and the carbon equivalent are too high.

Silicon: Si is a solid solution strengthening element. On the one hand, Si can improve the strength of the material; on the other hand, Si can accelerate the segregation of carbon to austenite and purify the ferrite, thereby improving the performance of the finished product. In addition, silicon dissolved in the ferrite phase can promote work hardening to increase the elongation and improve the local stress strain, thereby contributing to the improvement of the bending property. However, excessive silicon added in the steel is easily concentrated on the surface to form an oxide film which is difficult to remove. Therefore, in the technical solution of the present invention, the mass percentage of Si is 0.1 to 0.6%.

Niobium: Nb is a precipitation element of carbonitrides. Nb can refine grains, precipitate carbonitrides and improve material strength. Therefore, the mass percentage of Nb in the cold-rolled annealed dual-phase steel according to the present invention is from 0.020 to 0.050%.

Titanium: Ti is a precipitation element of carbonitrides and is used to fix nitrogen and refine grains. Therefore, the mass percentage of Ti in the cold-rolled annealed dual-phase steel according to the present invention is from 0.020 to 0.050%.

Als: Al has the effects of deoxidizing and refining crystal grains in steel. Therefore, the mass percentage of Al is controlled to 0.015 to 0.045%.

Chromium: Cr can improve the hardenability of steel and facilitate the formation of martensite structure. Therefore, the mass percentage of Cr is controlled to 0.40 to 0.60%.

Molybdenum: Mo can improve the hardenability of steel, effectively increase the strength of steel, improve the distribution of carbides, and improve the overall performance of steel. In the case of not adding B, the technical solution of the present invention comprises Mo in a mass percentage of 0.2 to 0.4%. When the mass percentage of Mo is less than 0.2%, the effect thereof is not obvious, and the carbides cannot be dispersed. When the mass percentage of Mo is higher than 0.4%, the strength is too high.

Calcium: Ca precipitates S in the form of CaS, suppresses the generation of cracks, and is advantageous for improving the bending property. In order to achieve the above effects, it is necessary to control the mass percentage of Ca to be 0.001% or more. However, if the mass percentage of Ca exceeds 0.005%, the effect thereof is saturated. Therefore, in the cold-rolled annealed dual-phase steel according to the present invention, the mass percentage of Ca is 0.001 to 0.005%.

Nitrogen: N is an impurity element in steel. Excessive N content tends to cause cracks on the surface of the slab.

Therefore, the lower the mass percentage of N is, the better it is. Considering the production cost and process conditions, the mass percentage of N is controlled to 0.005% or less.

Phosphorus: P is an impurity element in steel. The lower the mass percentage of P is, the better it is. Considering the production cost and process conditions, P is 0.015% or less.

Sulfur: S is an impurity element in steel. The lower the mass percentage of S is, the better it is. Considering the production cost and process conditions, S is 0.005% or less.

Further, in the cold-rolled annealed dual-phase steel according to the present invention, the ratio of martensite phase is 50% or more, and the ratio of martensite phase to ferrite phase is more than 1 and less than 4.

In the above technical solutions, from the viewpoint of the comprehensive properties of strength and toughness, the microstructure of the cold-rolled annealed dual-phase steel requires a soft ferrite phase and a hard martensite phase. In order to achieve ultra-thin specifications and high strength, the ratio of martensite phase in the structure should be at least 50%. The ratio of martensite phase to ferrite phase is more than 1 and less than 4 for the following reasons. When the ratio of martensite phase to ferrite phase is greater than 1, the local deformation ability and the bending property of the material are improved. However, if the ratio of martensite phase to ferrite phase is more than 4, the elongation is drastically reduced due to the greatly reduced ferrite content. Therefore, the ratio of martensite phase to ferrite phase is more than 1 and less than 4.

Further, in the cold-rolled annealed dual-phase steel according to the present invention, the martensite has an average grain size of 3 to 6 μm.

In the above technical solutions, if the average grain size of martensite is too small, such crystal grains tend to become the origin of local cracks, resulting in a decrease in local deformability, and finally a decrease in bending ability. However, if the average grain size of martensite is too large, the degree of austenitization is too high, resulting in excessive high strength and excessive low elongation of the material. Therefore, the average grain size of the martensite is 3 to 6 μm.

Further, the cold-rolled annealed dual-phase steel according to the present invention has a tensile strength of 1000 MPa or more and an elongation at break of 12% or more.

Accordingly, it is another object of the present invention to provide a cold-rolled annealed dual-phase steel plate which is made of the above cold-rolled annealed dual-phase steel.

Further, the cold-rolled annealed dual-phase steel plate according to the present invention has a thickness of 0.5 to 0.7 mm.

Another object of the present invention is to provide a method for manufacturing the above cold-rolled annealed dual-phase steel plate. The steel plate obtained by the manufacturing method of the present invention has the advantages of high strength and ultra-thin size, and is suitable for use in automobiles, and is particularly suitable for preparing the frame and the back plate of seats.

In order to achieve the above object, the present invention provides a method for manufacturing the above cold-rolled annealed dual-phase steel plate, comprising the steps of:

(1) smelting and casting;
(2) hot rolling;
(3) cold rolling;
(4) annealing;
(5) temper rolling.

Further, in the manufacturing method according to the present invention, in the step (2), in order to ensure the stabilization of the rolling load, the heating temperature is preferably 1200° C. or higher. Meanwhile, in order to prevent an increase in oxidative burning loss, the upper limit of the heating temperature is preferably 1260° C. Therefore, the slab is soaked at a temperature of 1200 to 1260° C. and then rolled. In addition, considering the moldability after annealing and the unevenness of the structure due to coarse grains, the finish rolling temperature is 840 to 930° C., and after rolling, the slab is cooled at a rate of 20 to 70° C./s, and then coiled. The coiling temperature is preferably 500 to 620° C. from the viewpoint of the shape of hot rolling plate and the surface iron oxide scale.

Further, in the manufacturing method of the present invention, in the step (3), after removing the surface iron oxide scale by pickling, in order to form more polygonal ferrite in the structure, the cold rolling reduction ratio is controlled to 65 to 78%.

Further, in the manufacturing method of the present invention, in the step (4), the soaking temperature and time during annealing determine the degree of austenitization and eventually determine the ratio of martensite phase to ferrite phase in the structure. An over-high soaking temperature during annealing leads to an excessive proportion of the martensite phase, which ultimately leads to over-high strength of the obtained steel plate. However, if the soaking temperature during annealing is too low, the proportion of the martensite phase is too small, and eventually the strength of the obtained steel plate is low. In addition, if the soaking time during annealing is too short, the degree of austenitization is insufficient; if the soaking time during annealing is too long, austenite grains are coarsened. Therefore, in the manufacturing method of the present invention, the soaking temperature during annealing is controlled to 780 to 820° C., and the annealing time is 40 to 200 s. After annealing, rapidly cooling is performed at a rate of 45 to 100° C./s. The start temperature of rapidly cooling is 650 to 730° C., the aging temperature is 200 to 260° C., and the overaging time is 100 to 400 s.

Further, in the manufacturing method of the present invention, in the step (5), in order to secure the flatness of the steel plate, a certain amount of levelling is required. However, if the levelling amount is too large, the yield strength will rise too much. Therefore, in the manufacturing method of the present invention, the levelling reduction ratio is controlled to 0.3% or less.

The cold-rolled annealed dual-phase steel according to the present invention has a tensile strength of 1000 MPa or more, an elongation at break of 12% or more and excellent bending property. Therefore, the steel plates produced therefrom are suitable for use in the automotive industry, and are particularly suitable for preparing the frame and the back plate of seats.

The manufacturing method according to the present invention also has the above advantages.

DETAILED DESCRIPTION

The cold-rolled annealed dual-phase steel and the manufacturing method thereof according to the present invention will be further explained and illustrated below with reference to the specific Examples. However, the explanations and illustrations do not unduly limit the technical solutions of the present invention.

Examples 1-6 and Comparative Examples 1-9

Table 1 lists the mass percentages of chemical elements in the cold-rolled annealed dual-phase steels of Examples 1-6 and the conventional steels of Comparative Examples 1-9.

TABLE 1

(wt %, the balance is Fe and other inevitable impurity elements other than P, S, N)

| No. | C | Si | Mn | P | S | Cr | Mo | Nb | Ti | Al | N | Ca |
|---|---|---|---|---|---|---|---|---|---|---|---|---|
| Example 1 | 0.095 | 0.24 | 2.08 | 0.012 | 0.004 | 0.52 | 0.25 | 0.028 | 0.024 | 0.035 | 38 ppm | 0.004 |
| Example 2 | 0.09 | 0.18 | 2.02 | 0.01 | 0.002 | 0.48 | 0.28 | 0.025 | 0.034 | 0.028 | 42 ppm | 0.003 |
| Example 3 | 0.088 | 0.35 | 1.99 | 0.01 | 0.003 | 0.55 | 0.32 | 0.033 | 0.029 | 0.040 | 27 ppm | 0.003 |
| Example 4 | 0.1 | 0.10 | 2.12 | 0.014 | 0.003 | 0.40 | 0.20 | 0.020 | 0.042 | 0.022 | 12 ppm | 0.001 |
| Example 5 | 0.083 | 0.60 | 1.95 | 0.013 | 0.002 | 0.60 | 0.40 | 0.050 | 0.020 | 0.045 | 50 ppm | 0.002 |
| Example 6 | 0.08 | 0.47 | 2.20 | 0.015 | 0.005 | 0.43 | 0.38 | 0.043 | 0.050 | 0.015 | 9 ppm | 0.005 |
| Comparative Example 1 | 0.098 | 0.33 | 2.2 | 0.011 | 0.005 | 0.58 | 0.36 | 0.027 | 0.025 | 0.026 | 42 ppm | 0.002 |
| Comparative Example 2 | 0.087 | 0.45 | 2.03 | 0.013 | 0.001 | 0.48 | 0.22 | 0.023 | 0.024 | 0.032 | 39 ppm | 0.002 |
| Comparative Example 3 | 0.086 | 0.37 | 2.11 | 0.009 | 0.003 | 0.51 | 0.26 | 0.024 | 0.026 | 0.04 | 33 ppm | 0.005 |
| Comparative Example 4 | 0.081 | 0.12 | 1.96 | 0.006 | 0.004 | 0.43 | 0.21 | 0.025 | 0.02 | 0.028 | 35 ppm | 0.002 |
| Comparative Example 5 | 0.091 | 0.36 | 2.08 | 0.007 | 0.006 | 0.47 | 0.28 | 0.022 | 0.025 | 0.028 | 40 ppm | 0.004 |
| Comparative Example 6 | ***0.079*** | 0.42 | 2.04 | 0.01 | 0.004 | 0.44 | 0.3 | 0.029 | 0.029 | 0.019 | 30 ppm | 0.002 |
| Comparative Example 7 | 0.089 | 0.28 | 1.97 | 0.014 | 0.005 | ***0.66*** | 0.21 | 0.024 | 0.022 | 0.025 | 28 ppm | 0.002 |
| Comparative Example 8 | 0.083 | 0.29 | 2.16 | 0.014 | 0.002 | 0.52 | 0.23 | 0.026 | 0.028 | 0.033 | 35 ppm | 0.001 |
| Comparative Example 9 | ***0.101*** | 0.25 | 2.09 | 0.008 | 0.007 | 0.49 | 0.25 | 0.025 | 0.026 | 0.024 | 38 ppm | 0.004 |

The cold-rolled annealed dual-phase steels of Examples 1-6 and the conventional steels of Comparative Examples 1-9 are made into steel plates by a manufacturing method including the following steps:

(1) smelting and casting according to the mass percentages of chemical elements listed in Table 1;

(2) hot rolling: the slab was soaked at a temperature of 1200 to 1260° C. and then rolled; the finish rolling temperature was 840 to 930° C.; after rolling, it was cooled at a rate of 20 to 70° C./s, and then coiled; the coiling temperature was 500 to 620° C.;

(3) cold rolling: the cold rolling reduction ratio was 65 to 78%;

(4) annealing: the soaking temperature during annealing was 780 to 820° C., and the annealing time was 40 to 200 s; after annealing, rapidly cooling was performed at a rate of 45 to 100° C./s; the start temperature of rapidly cooling was 650 to 730° C., the aging temperature was 200 to 260° C., and the overaging time was 100 to 400 s;

(5) temper rolling at a reduction ratio of 0.3% or less.

Table 2 lists the specific process parameters of the manufacturing methods of the cold-rolled annealed dual-phase steels of Examples 1-6 and the conventional steels of Comparative Examples 1-9.

TABLE 2

| | Step (2) | | | | Step (3) | Step (4) | | | | | | Step (5) |
|---|---|---|---|---|---|---|---|---|---|---|---|---|
| | | | | | | Soaking | | Start | | | | |
| No. | Soaking temperature (° C.) | Finish temperature (° C.) | Cooling rate (° C./s) | Coiling temperature (° C.) | Cold rolling reduction (%) | temperature during annealing (° C.) | Annealing time (s) | Rapid cooling rate (° C./s) | temperature of rapidly cooling (° C.) | Aging temperature (° C.) | Overaging time (s) | Temper rolling reduction (%) |
| Example 1 | 1240 | 895 | 20 | 580 | 78 | 785 | 40 | 60 | 670 | 250 | 200 | 0.2 |
| Example 2 | 1230 | 880 | 30 | 590 | 70 | 790 | 80 | 45 | 660 | 230 | 100 | 0.1 |
| Example 3 | 1250 | 900 | 60 | 570 | 65 | 800 | 120 | 70 | 650 | 240 | 300 | 0.2 |
| Example 4 | 1200 | 930 | 70 | 620 | 72 | 810 | 160 | 55 | 730 | 200 | 400 | 0.3 |
| Example 5 | 1210 | 850 | 40 | 540 | 75 | 820 | 180 | 85 | 690 | 220 | 150 | 0.1 |
| Example 6 | 1260 | 840 | 50 | 500 | 68 | 780 | 200 | 100 | 700 | 260 | 350 | 0.1 |
| Comparative Example 1 | 1220 | ***830*** | 40 | 610 | 70 | 820 | 40 | 60 | 650 | 210 | 250 | 0.3 |
| Comparative Example 2 | 1210 | 860 | 50 | 580 | 75 | 800 | 50 | 80 | 700 | 200 | 350 | 0.1 |
| Comparative Example 3 | ***1270*** | 920 | 40 | 540 | 82 | 795 | 70 | 75 | 680 | 260 | 200 | 0.1 |
| Comparative Example 4 | ***1190*** | 910 | 30 | 550 | 66 | ***775*** | 60 | ***40*** | 690 | 240 | 150 | 0.1 |
| Comparative Example 5 | 1250 | 890 | 20 | ***630*** | 74 | 800 | 160 | 100 | 710 | 230 | 100 | 0.2 |
| Comparative Example 6 | 1200 | ***820*** | 50 | 600 | 66 | 805 | 120 | 95 | 720 | 220 | 250 | 0.3 |
| Comparative Example 7 | 1240 | 870 | 30 | 620 | 69 | 780 | 100 | 65 | ***640*** | 250 | 400 | 0.1 |
| Comparative Example 8 | 1210 | ***950*** | 40 | 585 | 68 | 810 | 80 | 45 | 670 | 210 | 350 | 0.2 |
| Comparative Example 9 | 1200 | 900 | 20 | 565 | 71 | 795 | 150 | 60 | ***740*** | 240 | 300 | 0.2 |

Table 3 lists the typical microstructure, mechanical properties, and bending property of steel plates made of the cold-rolled annealed dual-phase steels of Examples 1-6 and the conventional steels of Comparative Examples 1-9.

TABLE 3

| | Microstructure | | | | Mechanical property | | | | |
|---|---|---|---|---|---|---|---|---|---|
| No. | Ratio of ferrite phase (%) | Ratio of martensite phase (%) | Ratio of martensite phase to ferrite phase | Martensite grain size (μm) | Yield strength (MPa) | Tensile strength (MPa) | Elongation at break (%) | Plate thickness (mm) | Ultimate bending radius/plate thickness |
| Example 1 | 26 | 74 | 2.85 | 3.75 | 702 | 1055 | 13 | 0.53 | 0.6 |
| Example 2 | 34 | 66 | 1.94 | 4.29 | 675 | 1036 | 15 | 0.66 | 0.5 |
| Example 3 | 43 | 57 | 1.33 | 5.5 | 643 | 1028 | 14 | 0.72 | 0.57 |
| Example 4 | 50 | 50 | 1.0 | 3.0 | 735 | 1072 | 12 | 0.70 | 0.55 |
| Example 5 | 45 | 55 | 1.22 | 4.5 | 624 | 1011 | 15 | 0.56 | 0.62 |
| Example 6 | 20 | 80 | 4.0 | 6.0 | 608 | 1002 | 16 | 0.68 | 0.59 |
| Comparative Example 1 | 8 | 92 | ***11.5*** | ***2.16*** | 822 | 1126 | 7 | 0.58 | 1.72 |
| Comparative Example 2 | 17 | 83 | ***4.88*** | 5.11 | 696 | 1045 | 12 | 0.64 | 1.02 |
| Comparative Example 3 | 24 | 76 | 3.17 | ***8.58*** | 763 | 1087 | ***10*** | 0.67 | 1.24 |
| Comparative Example 4 | 65 | ***35*** | ***0.54*** | 4.74 | 522 | ***874*** | 21 | 0.62 | 0.54 |
| Comparative Example 5 | 22 | 78 | 3.55 | ***1.43*** | 726 | 1074 | ***11*** | 0.54 | 0.98 |
| Comparative Example 6 | 42 | 58 | 1.38 | ***6.77*** | 693 | 1042 | ***11*** | 0.62 | 1.16 |
| Comparative Example 7 | 14 | 86 | ***6.42*** | 4.65 | 688 | 1039 | 12 | 0.69 | 0.94 |
| Comparative Example 8 | 52 | ***48*** | ***0.92*** | ***7.95*** | 663 | 1032 | 14 | 0.59 | 1.07 |
| Comparative Example 9 | 36 | 64 | 1.78 | ***2.57*** | 677 | 1045 | 13 | 0.68 | 0.93 |

As can be seen from table 3, each of the cold-rolled annealed dual-phase steels of Examples 1-6 has a tensile strength of 1000 MPa or more, an elongation at break of 12% or more, and a microstructure of ferrite and martensite, wherein the ratio of martensite phase is 50% or more, and the ratio of martensite phase to ferrite phase is more than 1 and less than 4, and the average grain size of martensite is 3 to 6 μm. The steel plate of each of the Examples has a thickness of 0.5 to 0.7 mm. It can be seen that the steel plate made of the cold-rolled annealed dual-phase steel of each of the Examples of the present invention has the advantages of high strength, thin thickness, and good bending property.

It should be noted that the above are merely illustrative of specific Examples of the invention. It is obvious that the present invention is not limited to above Examples, but has many similar variations. All variations that can be directly derived or conceived by those skilled in the art from this disclosure are intended to be within the scope of the present invention.

The invention claimed is:

1. A cold-rolled annealed dual-phase steel plate, wherein the steel plate has a microstructure of ferrite and martensite, and consists of the following chemical elements in mass percentage:

0.08% to 0.1% of C, 1.95% to 2.2% of Mn, 0.1% to 0.6% of Si, 0.020% to 0.050% of Nb, 0.020% to 0.050% of Ti, 0.015% to 0.045% of Sol. Al, 0.40% to 0.60% of Cr, 0.2% to 0.4% of Mo, 0.001% to 0.005% of Ca, and the balance being Fe and other inevitable impurities; wherein the martensite has an average grain size of 3 to 6 μm.

2. The cold-rolled annealed dual-phase steel plate as claimed in claim 1, wherein a ratio of martensite phase is 50% or more, and a ratio of martensite phase to ferrite phase is more than 1 and less than 4.

3. The cold-rolled annealed dual-phase steel plate as claimed in claim 1, wherein the steel plate has a tensile strength of 1000 MPa or more and an elongation at break of 12% or more.

4. The cold-rolled annealed dual-phase steel plate as claimed in claim 1, wherein the steel plate has a thickness of 0.5 to 0.7 mm.

* * * * *